US005094763A

United States Patent [19]

Tochigi et al.

[11] Patent Number: 5,094,763

[45] Date of Patent: Mar. 10, 1992

[54] HYDRAULIC FLUID COMPOSITION FOR POWER STEERING CONTAINING A PHOSPHOROUS COMPOUND AND A THIADIAZOLE DERIVATIVE

[75] Inventors: Hiroshi Tochigi; Yasunori Hirose, both of Saitama; Hiroto Kikuchi, Kanagawa, all of Japan

[73] Assignee: Cosmo Oil Co., Ltd., Kanagawa, Japan

[21] Appl. No.: 477,386

[22] Filed: Feb. 9, 1990

[30] Foreign Application Priority Data

Feb. 10, 1989 [JP] Japan ..... 1-31628

[51] Int. Cl.[5] ..... C10M 135/36; C10M 137/12; C10M 137/14

[52] U.S. Cl. ..... 252/46.6; 252/78.5; 252/77; 252/71

[58] Field of Search ..... 252/46.6, 46.7, 47.5, 252/51.5 A, 71, 75, 77, 78.5

[56] References Cited

U.S. PATENT DOCUMENTS

| | | | |
|---|---|---|---|
| 3,879,306 | 4/1975 | Kablaoui et al. | 252/51.5 A |
| 3,901,932 | 8/1975 | Tada et al. | 558/179 |
| 3,923,669 | 12/1975 | Newingham et al. | 252/75 |
| 3,980,573 | 9/1976 | Okorodudu | 252/46.7 |
| 4,661,273 | 4/1987 | Frangatos et al. | 252/47 |

FOREIGN PATENT DOCUMENTS

| | | |
|---|---|---|
| 157188 | 9/1984 | Japan . |
| 86/04601 | 8/1986 | PCT Int'l Appl. . |
| 87/07637 | 12/1987 | PCT Int'l Appl. . |
| 1506917 | 4/1978 | United Kingdom . |

*Primary Examiner*—Prince Willis, Jr.
*Assistant Examiner*—James M. Silbermann
*Attorney, Agent, or Firm*—Sughrue, Mion, Zinn, Macpeak & Seas

[57] ABSTRACT

A hydraulic fluid composition for power steering is disclosed, which comprises (a) at least one phosphorus containing compound selected from the group of alkyl, or alkyl substituted or unsubstituted phenyl phosphorus acid compounds, alkyl, or alkyl substituted or unsubstituted phenyl phosphorus thioacid compounds, alkyl, or alkyl substituted or unsubstituted phenyl phosphorus dithioacid compounds, and (b) one or more thiadizaole derivatives represented by the formula:

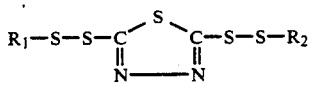

where $R_1$ and $R_2$ independently denote a linear or branched alkyl group having 1 to 12 carbons. The composition enables hydraulic systems to be used for longer times without accelerating deterioration of rubber materials employed in the hydraulic system.

12 Claims, No Drawings

HYDRAULIC FLUID COMPOSITION FOR POWER STEERING CONTAINING A PHOSPHOROUS COMPOUND AND A THIADIAZOLE DERIVATIVE

FIELD OF THE INVENTION

The present invention relates to a working fluid composition for power steering, more particularly to a hydraulic fluid composition for a hydraulic power steering system which multiplies steering power by an oil pump driven by engine and a control valve, an actuator, etc, actuated by a driver's steering.

BACKGROUND OF THE INVENTION

Power steering systems, which were employed in approximately 20% of all passenger cars about five years ago, have recently become so popular that approximately 80% of all passenger cars employ a power steering system. Accordingly, the type of the hydraulic fluid for power steering is changing from the double-purpose type which also employs automatic transmission fluid (AFT) to the single-purpose type which is an oil for power steering.

In use, a hydraulic fluid for power steering is circulated by means of a vane pump or a gear pump at a pressure of from about 80 to about 105 kg/cm$^2$G at a temperature of about 60° to about 120° C. Moreover, the hydraulic fluid is normally not replaced before the car is scrapped. Moreover, the hydraulic fluid is required to have low temperature starting characteristics and to provide smooth cylinder movement in cold areas. Therefore, the hydraulic fluid should prevent abrasion, should show low temperature fluidability, have good thermal oxidation stability, have low friction characteristics and be inert to sealing materials used in the power steering system. To satisfy these requirements, various additives are incorporated in a selected base oil to provide a hydraulic fluid composition for power steering.

DESCRIPTION OF THE PRIOR ART

Heretofore, most hydraulic fluids for power steering contained zinc dithiophosphate which serves as an abrasion preventing and oxidation preventing agent for the purpose of satisfying the above mentioned requirements. Such a fluid may deteriorate rubber parts in the power steering system on prolonged use at normal service temperature of 60° to 100° C. to form cracks in, such rubber parts, thus causing leakage of the fluid or malfunction of the power systems.

The inventors of the present invention assumed that the combination of the rubber parts in the system caused dissolution of copper or plated copper in the system into the hydraulic fluid and the copper reacted with the nitrile group of nitrile rubber parts to form a complex, resulting in the deterioration (hardening) of rubber (nitrile rubber) in the hydraulic system. The dissolution of the copper is assumed to be first due to the elution of copper caused by the added zinc dithiophosphate. The elution of copper is decreased to some extent in systems which do not contain zinc dithiophosphate, but cannot completely be prevented, so that the deterioration of the rubber material cannot be avoided. For this reason, an additive to replace zinc dithiophosphate as well as an additive capable of effectively suppressing the dissolution of copper has been desired.

SUMMARY OF THE INVENTION

The inventors of the present invention, after extensive research to solve the above problems, found that the dissolution of copper into the hydraulic fluid is inhibited by adding a phosphorus acid compound in combination with a thiadiazole derivative, and with such combination it is not necessary to use zinc dithiophosphate, and thus completed the present invention.

An object of the present invention is to provide a novel hydraulic fluid composition for power steering systems.

Another object of the present invention is to provide a hydraulic fluid composition for power steering systems which enables stable use of hydraulic systems for a long term without accelerating the deterioration of rubber materials employed in the hydraulic system.

The present invention provides a hydraylic fluid composition for power steering systems comprising;

(a) at least one phosphorus-containing compound selected from the group consisting of alkyl, or alkyl-substituted or unsubstituted phenyl phosphorus acid compounds, alkyl, or alkyl substituted or unsubstituted phenyl phosphorus thioacid compounds, and alkyl, or alkyl substituted or unsubstituted phenyl phosphorus dithioacid compounds, and (b) one or more thiadiazole derivatives represented by the formula:

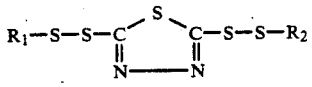

where $R_1$ and $R_2$ independently denote a linear or branched alkyl group having 1 to 12 carbons.

DETAILED DESCRIPTION OF THE INVENTION

The alkyl, or alkyl substituted or unsubstituted phenyl phosphorus acid compounds employed in the present invention include phosphite esters represented by the formula:

$$(R_3O)_3{-}P \text{ or } (R_4O)_2{-}\overset{\overset{\displaystyle O}{\|}}{P}{-}H,$$

phosphonate esters represented by the formula:

$$(R_5O)_2{-}\overset{\overset{\displaystyle O}{\|}}{P}{-}R_6,$$

orthophosphate esters represented by the formula:

$$(R_7O)_3P{=}O),$$

pyrophosphate esters represented by the formula:

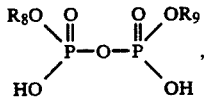

acid phosphate esters represented by the formula:

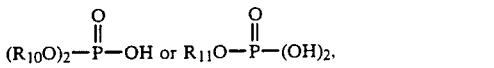

and neutral amine salts or partially neutralized amine salts of acid phosphate esters represented by the formula:

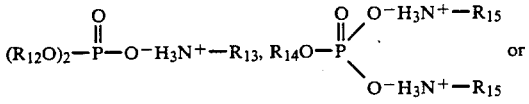

or

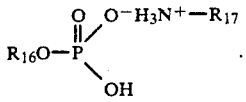

The alkyl, or alkyl substituted or unsubstituted phenyl phosphorus thioacid compounds include thiophosphate esters represented by the formula:

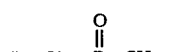

acid thiophosphate esters represented by the formula:

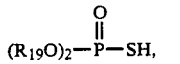

and neutral amine salts or partially neutralized amine salts of acid thiophosphate esters represented by the formula:

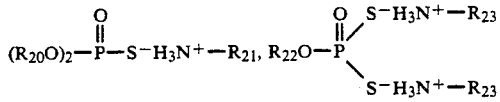

or

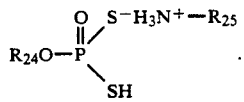

The alkyl, or alkyl substituted or unsubstituted phenyl phosphorus dithioacid compounds include dithiophosphate esters represented by the formula:

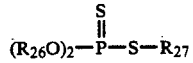

and acid dithiophosphate esters represented by the formula:

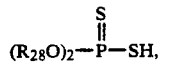

and neutral amine salts or partially neutralized amine salts of acid dithiophosphate esters represented by the formula:

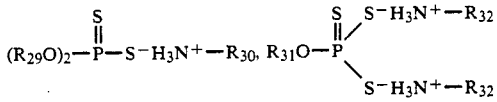

or

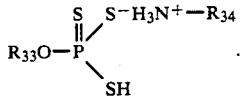

$R_3$ to $R_{34}$ for these phosphorus compounds represent alkyl, or alkyl substituted phenyl or unsubstituted phenyl groups. These phosphorus compounds are already known in the art.

The alkyl group of the phosphorus compounds is a straight or branched alkyl having 1 to 18 carbons. Specific examples thereof are methyl, ethyl, propyl, butyl, hexyl, octyl, nonyl, hexadecyl, octadecyl, etc.

The alkyl group of the alkyl substituted phenyl group is the same as above.

These phosphorus compounds may be employed singly or as a combination of two or more thereof. The phosphorus compounds are added singly or as a combination of two or more thereof in an amount ranging from about 0.005% to about 0.5% by weight in terms of phosphorus content based on the base oil, preferably from about 0.02% to 0.07% by weight. The addition of too much thereof does not give a corresponding effect while cost increases, while insufficient addition does not give the intended effect.

One or more of the thiadiazole derivatives represented by the formula below of the present invention:

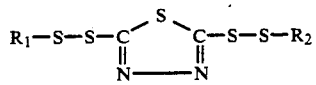

(I)

where $R_1$ and $R_2$ independently denote straight or branched alkyl groups having 1 to 12 carbons, are added, preferably in an amount ranging from about 0.007% to about 0.33% by weight in terms of sulfur content, more preferably from about 0.018% to about 0.18% by weight based on the base oil.

The thiadiazole derivatives can be prepared, for example, according to the method disclosed in U.S. Pat. Nos. 2,719,125, and 2,719,126.

Preferable thiadiazole derivatives have a straight or branched alkyl group of 1 to 12 carbons, more preferably 1 to 8 carbons, as $R_1$ and $R_2$ in formula (I), respectively. Particularly preferable is 2,5-bis(tert-octyldithio)-1,3,4-thiadiazole. Specific examples of $R_1$ and $R_2$ groups are methyl, ethyl, propyl, butyl, hexyl, and octyl.

The base oil employed in the present invention may be a mineral oil purified by a solvent treatment or a hydrogenation treatment, or a synthetic oil as mentioned below, having an appropriate viscosity. Examples of synthetic oils are poly-α-olefins, polybutenes, diesters, polypropylenes, polyglycols, hindered esters, etc. However, poly-α-olefins, polybutenes, and polypropylenes which are analoguous to mineral oil are preferable in consideration of the solubility of additives therein.

The hydraulic fluid composition of a power steering system per the present invention may additionally contain known additives in conventional amounts such as an anticorrosion agent, e.g., an amine; an antioxidizing agent, e.g., of the phenol type; a viscosity index improver, e.g., a polymethacrylate; a detergent dispersant, e.g., a sulfonate; and an antifoaming agent.

More particularly, the anticorrosion agents include amine type anticorrosion agents, alkenylsuccinic imides, alkenyl succinic esters, etc. The antioxidation agents include those of the amine type, the phenol type, etc. The viscosity index improvers include polymethacrylates, olefin copolymers, etc. Useful detergents of the metal type include alkaline earth metal sulfonate, alkaline earth metal phenates, etc. Useful ashless type dispersants include alkenylsuccinic imides, alkenylsuccinic esters, amides of a long-chain fatty acid with a polyamine (amino-amido type), etc. Useful friction controlling agents such as a fatty acid and an organic molybdenum compound may be used. Useful antifoaming agents include silicone compounds, esters, etc.

Zinc dithiophosphate may be present in an amount that does not affect elution of rubber additives: namely, less than about 0.01% by weight based on the total composition. The total amount of the additives in the composition of the present invention is preferably from 2.0% to 20% by weight, more preferably 3.0% to 15% by weight.

Generally, hydraulic fluids for power steering have a viscosity of approximately 5 to 9 centistokes, preferably approximately 7 to 8 centistokes, at 100° C., and a viscosity from about 200 centipoise to about of 50,000 centipoise or less, preferably from about 500 to about 5,000 centipoise or less, at −20° C. Therefore, a base oil is preferably used which has a viscosity of approximately 3.0 to 6.0 centistokes, preferably approximately 3.0 to 4.5 centistokes at 100° C., to which a polymethacrylate type polymer, or a combination of polypropylene or polybutene with a polymethacrylate type polymer are added in order to increase the viscosity and to lower the pour point.

Generally, the polymethacrylate type polymer used in the present invention has a weight average molecular weight (Mw) of about 50,000 to 400,000 and a number average molecular weight (Mn) of about 20,000 to 150,000, and it is added in the range of about 2 wt % to 10 wt % based on the base oil.

Generally, the polypropylene used in the present invention has a weight average molecular weight of about 40,000 to 250,000 and the polybutene used in the present invention has a weight average molecular weight of about 50,000 to 300,000, and they are added in the range of about 2 wt % to 15 wt % based on the base oil.

The hydraulic fluid for power steering of the present invention, which contains the phosphorus compound and the thiadiazole derivative, is capable of preventing damage to piston sealing materials of a power cylinder caused by corrosion, thus preventing leakage of the hydraulic fluid, and providing long term, stable power steering operation, which could not be achieved by the prior art, without impairing other performance levels of conventional power steering hydraulic fluids.

The present invention is now illustrated by Examples and Comparative Examples. In the Examples and the Comparative Examples, the compositions were evaluated as below.

Metal corrosion test

This test comprises two test stages: a pretreatment of extracting rubber compounding ingredients (extraction test), and a metal corrosion test employing the above extraction liquid.

The procedure of the extraction test is as follows:

(1) A Teflon stirrer is put in a 1000 ml glass beaker and a stainless metal gauze is set in the bottom of the beaker in such a manner that the metal gauze does not prevent turning of the stirrer.

(2) A rectangular rubber component is placed on the stainless metal gauze.

(3) 800 ml of test oil is poured into the beaker, and the test is conducted according to the following test condition.

The procedure of metal corresion test is as follows:

(1) With respect to the metal catalyst, a steel plate, a cast iron plate and an aluminum plate are installed on a copper plate in almost similar intervals using a stainless bolt and a Teflon washer. Then this copper plate is changed into a pipe shape and inserted into a 400 ml glass beaker.

(2) Next, the oil obtained after the extraction test is poured into the glass beaker and the test is conducted according to the following test condition.

The metal content and the change in the weight and appearance of the metal catalyst are evaluated after the corrosion test.

| | |
|---|---|
| **Extraction test conditions** | |
| Temperature: | 100° C. |
| Method of stirring: | Stirrer, about 200 r.p.m. |
| Time: | 96 hours |
| Rubber Part: | A rubber part (butadiene/acrylonitrile copolymer; hardness (Hs) 74 point, tensile strength 150 kgf/cm$^2$, extension 270%) used in a hydraulic system is peeled off and cut into rectangular pieces of 5 cm in length, 2 cm in width, and 0.2 cm in thickness for the test. |
| **Metal corrosion test conditions** | |
| Tester: | Indiana stirring oxidation stabilization tester (JIS K2514 3.1) |
| Test oil: | 300 ml (the oil used for extraction) |
| Temperature: | 100° C. |
| Rotation speed: | 1300 r.p.m. |
| Time: | 144 hours |
| Metal catalyst: | Copper plate (75 × 180 × 0.8 mm), steel plate, cast iron plate, and aluminum plate (respectively 12 × 80 × 0.8 mm) |

Rubber material deterioration test

The procedure of the rubber material deterioration test is as follows:

(1) 150 ml of the oil which is obtained after the metal corrision test is poured into a 200 ml beaker.

(2) A sealing material (U packing having outer diameter of 34 mm and inner diameter of 22 mm) is suspended on a stainless wire (diameter 1 mm) and the sealing material is dipped into the oil.

(3) The sealing material is allowed to stand according to the following test condition.

(4) After the test, the sealing material is taken off from the beaker and washed with n-hexane. The groove of the sealing material is observed with a light microscope (100 magnifications) to see if foreign matter is formed.

| Test conditions | |
|---|---|
| Test oil: | 150 ml (oil after metal corrosion test) |
| Temperature: | 100° C. |
| Time: | 144 hours |
| Sealing material: | NBR (hardness (Hs) 75 point, tensile strength 190 kgf/cm$^2$), acrylic rubber (hardness (Hs) 70 point, tensile strength 104 kgf/cm$^2$, extension 200%) |

Actual Driving Test

The test oil is charged to a test car (commercially available 1800 cc gasoline engine car having a rack-and-pinion type power steering system), and is tested under normal driving conditions for an extended period. The hydraulic system is then disassembled to observe the state of the rubber therein and to determine the quantity of copper in the oil.

EXAMPLES 1 TO 6, AND COMPARATIVE EXAMPLES 1 TO 4

The compositions employed in the Examples and Comparative Examples are shown in Table 1.

The tricresyl phosphate used in Example 1 had a phosphorus content of 8.4% by weight and a total acid value of 0.05 mgKOH/g. The trilauryl phosphate used in Examples 2 and 3 and Comparative Example 4 had a phosphorus content of 5.1% by weight and a total acid value of 0.05 mqKOH/g. The tris-nonylphenyl phosphite used in Example 4 had a phosphorus content of 7.4% by weight. The trialkyl thiophosphate (where the alkyl was $C_{12}/C_{13}$=50/50 by mol) used in Example 5 had a phosphorus content of 4.8% by weight and a sulfur content of 5.4% by weight. The di(2-ethylhexyl) dithiophosphate used in Example 6 had a phosphorus content of 8.8% by weight, and a sulfur content of 17.4% by weight.

The 2,5-bis(tert-octyldithio)-1,3,4-thiadiazole used in Examples 1 to 6 and Comparative Example 1 had a sulfur content of 35.8% by weight, and a nitrogen content of 6.0% by weight.

Other additives used in Examples and Comparative Examples were as below. The succinic imide dispersant was made by KARONITE CHEMICAL CO., LTD. with the trade name "OLOA-1200" (nitrogen content of 2.1% by weight). The polymethacrylate viscosity index improver was made by Sanyo Chemical Industries, Ltd. with the trade name of "Aclube 516". The Ca sulfonate had a calcium content of 11.5% by weight and a total base number of 300 mqKOH/g. The magnesium sulfonate had a magnesium content of 9.5% and a total base number of 400 mqKOH/g. The alkyldiphenylamine had a nitrogen content of 3.4% by weight; it was made by R.T. Vanderbilt Co., Inc. with the trade name of "VANLUBE". The zinc di(2-ethyl hexyl)dithiophosphate had a zinc content of 8.8% by weight. The 1,2,3-benzotriazole had a nitrogen content of 22% by weight. The silicone type defoaming agent was made by Shin-Etsu Chemical Co., Ltd. with the trade name of "KF-96"(10,000 centistokes at 25° C.).

As shown in Table 2, in the case of fluids containing a phosphate ester or a phosphite ester, and 2,5-bis(tert-octyldithio)-1,3,4-thiadiazole (Examples 1 to 6), the elution of copper was inhibited, rubber was not affected, and no abnormality was observed in the actual driving test. In the case of fluids containing zinc dithiophosphate (Comparative Examples 1 to 3), copper elution was significant and the rubber material was deteriorated, even with 2,5-bis(tert-octyldithio)-1,3,4-thiadiazole added to the fluid (Comparative Example 1).

Moreover, 1,2,3-benzotriazole, which is considered to be usually effective in copper elution inhibition, was not effective (Comparative Examples 2 and 4).

As shown in Table 3, the hydraulic fluid composition of the present invention had appropriate properties such as a suitable viscosity for use as a hydraulic fluid for a hydraulic system.

TABLE 1

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Base oil 1) | Neutral mineral oil | | | | | | | | | |
| Kinematic viscosity, cSt at 100° C. | 3.7 | 4.3 | 3.9 | 3.0 | 3.7 | 3.7 | 3.7 | 3.7 | 4.3 | 3.9 |
| Additive 2) | | | | | | | | | | |
| Tricresyl phosphate | 0.4 | — | — | — | — | — | — | — | — | — |
| Trilauryl phosphate | — | 0.4 | 0.2 | — | — | — | — | — | — | 0.4 |
| Tris-nonylphenyl phosphite | — | — | — | 0.4 | — | — | — | — | — | — |
| Trialkyl thiophosphate | — | — | — | — | 0.63 | — | — | — | — | — |
| Di-(2-ethylhexyl) dithiophosphate | — | — | — | — | — | 0.34 | — | — | — | — |
| 2,5-bis(tert-octyldithio)-1,3,4-thiadiazole | 0.1 | 0.15 | 0.1 | 0.15 | 0.1 | 0.1 | 0.15 | — | — | — |
| Succinic imide dispersant | 1.0 | 1.0 | 1.0 | 1.0 | 1.0 | 1.0 | 1.0 | 1.0 | 1.0 | 1.0 |
| Polymethacrylate V.I. improver | 7.0 | 3.2 | 5.9 | 9.0 | 7.0 | 7.0 | 7.0 | 7.0 | 3.2 | 3.2 |
| Calcium sulfonate | 0.05 | 0.05 | — | — | 0.05 | 0.05 | 0.05 | 0.05 | — | — |
| Magnesium sulfonate | — | — | 0.05 | 0.05 | — | — | — | — | 0.05 | 0.05 |
| Alkyl($C_2H_5$(50)/$C_9H_{19}$(50)) diphenyl amine | 1.0 | 1.0 | 1.0 | 1.0 | 1.0 | 1.0 | 1.0 | 1.0 | 1.0 | 1.0 |
| Silicone defoaming agent | 0.002 | 0.002 | 0.002 | 0.002 | 0.002 | 0.002 | 0.002 | 0.002 | 0.002 | 0.002 |
| Zinc di(2-ethyl | — | — | — | — | — | — | 0.7 | 0.5 | 0.4 | — |

TABLE 1-continued

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| hexyl)dithio-phosphate | | | | | | | | | | |
| 1,2,3-benzotriazole | — | — | — | — | — | — | — | 0.15 | — | 0.10 |

Remark 1) The mixture of highly refined and hydrogenated paraffin oil (A) (32 cSt at 40° C.) with hydrogenated dewaxed oil (B) (12 cSt at 40° C.)
Remark 2) The amount of the additive is in % by weight of the base oil.

TABLE 2

| | Metal corrosion test | Rubber material | Actual Driving test | |
|---|---|---|---|---|
| | Copper concentration (ppm) | deterioration test Change of properties 3) | Deterioration of rubber parts 4) | Copper in oil (ppm) |
| Example 1 | 21 | none | none | 38 |
| Example 2 | 15 | none | none | 50 |
| Example 3 | 13 | none | none | — |
| Example 4 | 14 | none | none | — |
| Example 5 | 24 | none | none | 42 |
| Example 6 | 28 | none | none | 52 |
| Comparative Example 1 | 180 | changed | deteriorated | 800 |
| Comparative Example 2 | 250 | changed | deteriorated | 900 |
| Comparative Example 3 | 350 | changed | — | — |
| Comparative Example 4 | 200 | changed | — | — |

Remark 3) Hardness, tensile strength, etc.
Remark 4) Deterioration in physical properties

TABLE 3

| Item | Example | | | | | |
|---|---|---|---|---|---|---|
| | 1 | 2 | 3 | 4 | 5 | 6 |
| Kinematic viscosity at 40° C. | 32.62 | 41.53 | 38.18 | 26.77 | 32.28 | 32.39 |
| cSt at 100° C. | 7.342 | 7.536 | 7.882 | 7.248 | 7.223 | 7.301 |
| cP at −20° C. | 1300 | 2500 | 1700 | 700 | 1350 | 1300 |
| Viscosity index | 201 | 151 | 184 | 257 | 198 | 201 |
| Total acid number, (mg/KOH/g) | 0.24 | 1.16 | 0.72 | 0.31 | 0.12 | 0.80 |
| Total base number, (mg/KOH/g) | 0.80 | 0.78 | 1.09 | 1.35 | 0.80 | 0.72 |
| Content of element 5), % by weight: | | | | | | |
| Sulfur | 0.036 | 0.054 | 0.036 | 0.054 | 0.070 | 0.095 |
| Phosphorus | 0.034 | 0.020 | 0.010 | 0.030 | 0.030 | 0.030 |
| Pour point, (°C.) | −55.0 | −47.5 | −50.0 | −57.5 | −52.5 | −52.5 |
| Pendulum II type friction coefficient | 0.13 | 0.12 | 0.12 | 0.12 | 0.13 | 0.13 |
| Oxidation stability (150° C., 96 hrs., JIS K2514) Viscosity ratio, at 40° C. | 1.0 | 1.0 | 1.0 | 1.0 | 1.0 | 1.0 |
| Load carrying property (JIS K2519) OK load, kg/cm$^2$ | 2.0 | 3.0 | 2.5 | 2.5 | 2.0 | 2.0 |

Remark 5) The amount of the elements coming from the additives.

While the invention has been described in detail and with reference to specific embodiments thereof, it will be apparent to one skilled in the art that various changes and modifications can be made therein without departing from the spirit and scope thereof.

What is claimed is:

1. A hydraulic fluid composition for power steering consisting essentially of:

(a) at least one phosphorous containing compound selected from the group consisting of alkyl, or alkyl substituted or unsubstituted phenyl phosphorous acid compounds; alkyl, or alkyl substituted or unsubstituted phenyl phosphorous thioacid compounds; and alkyl, or alkyl substituted or unsubstituted phenyl phosphorous dithioacid compounds, wherein said phosphorous containing compound is contained in an amount ranging from 0.005% to 0.5 by weight in terms of phosphorous content based on the base oil;

(b) one or more thiadiazole derivatives represented by the formula:

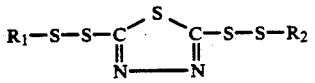

where $R_1$ and $R_2$ independently denote a linear or branched alkyl group having 1 to 12 carbons, wherein said thiadiazole derivative is contained in an amount ranging from 0.007% to 0.33% by weight in terms of sulfur content based on the base oil; and (c) a base oil.

2. The hydraulic fluid composition for power steering of claim 1, wherein said alkyl, or alkyl substituted or unsubstituted phenyl phosphorus acid compounds are selected from the group consisting of phosphite esters, phosphonate esters, orthophosphate esters, pyrophosphate esters, acid phosphate esters, and neutral amine salts or partially neutralized amine salts of acid phosphate esters.

3. The hydraulic fluid composition for power steering of claim 1, wherein said alkyl, or alkyl substituted or unsubstituted phenyl phosphorus thioacid compounds are selected from the group consisting of thiophosphate esters, acid thiophosphate esters, and neutral amine salts or partially neutralized amine salts of the acid thiophosphate esters.

4. The hydraulic fluid composition for power steering of claim 1, wherein said alkyl, or alkyl substituted or unsubstituted phenyl phosphorus dithioacid compounds are dithiophosphate esters, acid dithiophosphate esters, and neutral amine salts or partially neutralized amine salts of the acid dithiophosphate esters.

5. The hydraulic fluid composition for power steering of claim 2, wherein said alkyl group of the alkyl, or alkyl substituted or unsubstituted phenyl phosphorus acid compound is a straight or branched alkyl group having 1 to 18 carbons.

6. The hydraulic fluid composition for power steering of claim 3, wherein said alkyl group of the alkyl, or alkyl substituted phenyl phosphorus thioacid compound is a straight or branched alkyl group having 1 to 18 carbons.

7. The hydraulic fluid composition for power steering of claim 4, wherein said alkyl group of the alkyl, or alkyl substituted phenyl phosphorus dithioacid compound is a straight or branched alkyl group having 1 to 18 carbons.

8. The hydraulic fluid composition for power steering of claim 1, wherein said thiadiazole derivative is 2,5-bis(tert-octyldithio)-1,3,4-thiadiazole.

9. The hydraulic fluid composition for power steering of claim 1, wherein said phosphorus containing compound is contained in an amount ranging from about 0.02% to about 0.07% by weight in terms of phosphorus content based on the base oil.

10. The hydraulic fluid composition for power steering of claim 1, wherein said thiodiazole derivative is contained in an amount ranging from about 0.018% to about 0.18% by weight in terms of sulfur content based on the base oil.

11. The hydraulic fluid composition for power steering of claim 1, wherein the composition has a viscosity ranging from about 5 cSt to about 9 cSt at 100° C., and from about 200 cp to about 50,000 cp at −20° C.

12. The hydraulic fluid composition for power steering of claim 1, wherein the composition has a viscosity ranging from about 7 cSt to about 8 cSt at 100° C., and from about 500 cp to about 5,000 cp at −20° C.

* * * * *